US005280872A

United States Patent [19]

Yamanaka

[11] Patent Number: 5,280,872

[45] Date of Patent: Jan. 25, 1994

[54] VACUUM VALVE FOR A SEWAGE COLLECTION SYSTEM

[75] Inventor: Junichi Yamanaka, Tokoname, Japan

[73] Assignee: Inax Corporation, Tokoname, Japan

[21] Appl. No.: 986,620

[22] Filed: Dec. 7, 1992

[30] Foreign Application Priority Data

Jan. 7, 1992 [JP] Japan ..... 4-3608[U]

[51] Int. Cl.[5] ..... F16K 31/126

[52] U.S. Cl. ..... 251/61.5; 137/205

[58] Field of Search ..... 251/61, 61.2, 61.3, 251/333, 63.5, 63.6, 61.4, 61.5, 318, 324, 320, 321; 285/155; 137/205

[56] References Cited

U.S. PATENT DOCUMENTS

| | | | |
|---|---|---|---|
| 2,533,720 | 12/1950 | Danel | 285/155 |
| 4,171,853 | 10/1979 | Cleaver et al. | 251/61.5 X |
| 4,515,344 | 5/1985 | Gémignani | 251/63.5 |
| 4,765,586 | 8/1988 | Yoshida | 251/333 X |
| 5,078,174 | 1/1992 | Grooms et al. | 251/61.5 X |
| 5,082,238 | 1/1992 | Grooms et al. | 251/61.5 |

FOREIGN PATENT DOCUMENTS

| | | |
|---|---|---|
| 0445462 | 9/1991 | European Pat. Off. . |
| 11156 | 6/1909 | France . |
| 2149534 | 6/1985 | United Kingdom . |

*Primary Examiner*—Martin P. Schwadron
*Assistant Examiner*—Kevin L. Lee
*Attorney, Agent, or Firm*—Kanesaka and Takeuchi

[57] ABSTRACT

A vacuum valve comprises inlet and outlet pipes connected together to form a pipe line through which sewage flows, a valve element inclined to the pipe line and providing a selective communication between the inlet and outlet pipes, and a flexible or movable partition mounted within the valve to define a pressure chamber and connected to the valve element. The valve element is moved in an inclined manner in response to pressure differential between the pressure chamber and the interior of the outlet pipe. The outlet pipe has an axis displaced in a direction parallel to the axis of the inlet pipe and away from the valve element.

6 Claims, 3 Drawing Sheets

VACUUM VALVE FOR A SEWAGE COLLECTION SYSTEM

FIELD OF THE INVENTION AND RELATED ART STATEMENT

The present invention relates to a vacuum valve for use in a sewage collection system.

Sewage collection systems includes a vacuum sewage collection system wherein sewage discharged from a house is pulled through a pipe to a vacuum station under vacuum and then, delivered to a sewage treatment plant.

FIG. 2 shows one example of a vacuum sewage collection system. Generally, sewage discharged from a house flows down through an inlet pipe 100. The sewage is temporarily contained in a vacuum valve unit 102.

A vacuum station 104 includes a vacuum generator 106 to develop a vacuum. The sewage in the vacuum valve unit 102 is thereby pulled to the vacuum station 104 through a pipe 108. The sewage is then delivered to a sewage treatment plant by a pump.

The vacuum valve unit 102 comprises a sewage tank 110, a vacuum valve 112, and a controller 114. When the controller 114 detects that the sewage in the sewage tank 110 is elevated to a given level, the vacuum valve 112 is opened to allow the sewage to be pulled toward the pipe 108.

FIGS. 3A and 3B show this type of conventional vacuum valves. Referring to FIG. 3A, a vacuum valve 115 includes an inlet pipe 116, an outlet pipe 118, a valve element 120, a valve seat 122 on which the valve element 120 is seated, and a valve drive 123. A subatmospheric pressure is ported from the vacuum station 104 to the outlet pipe 118.

A flexible diaphragm is mounted within the valve drive 123 to define a pressure chamber. The valve element 120 has a valve rod 124 connected to the diaphragm.

In the vacuum valve 115, when sewage in the sewage tank 110 reaches a given level, the controller 114 is operated to deliver a subatmospheric pressure from the outlet pipe 118 through an inlet port 126 to the pressure chamber in the valve drive 123.

This results in that the subatmospheric pressures from the outlet pipe 118 and the pressure chamber are applied to the valve element 120 in opposite directions. However, as the area of the diaphragm is greater than that of the valve element 120, the valve element 120 is separated from the valve seat 122 to provide a communication between the inlet pipe 116 and the outlet pipe 118. The sewage is then pulled toward the vacuum station 104.

When the sewage in the sewage tank 110 is lowered to a given level, an atmospheric pressure is introduced to the pressure chamber to close the valve element 120.

In the vacuum valve 115, the valve element 120 is inclined to the pipe line composed of the inlet pipe 116 and the outlet pipe 118. To this end, a part of the pipe projects inwardly to provide the valve seat 122.

The pipe is thus throttled at the valve seat 122. This restricts the flow of sewage.

FIG. 3B shows another vacuum valve 128. While a valve seat is formed on the inner surface of one end of the inlet pipe 116, a part of the outlet pipe 118 is downwardly enlarged to prevent any throttling of the pipe.

In the vacuum valve 128, however, sewage flows along that enlarged portion 130 to increase the resistance to flow and tends to remain in the enlarged portion 130.

The sewage in the enlarged portion 130 may be iced, particularly in winter or cold districts. This results in an increase in the volume of the sewage and causes incomplete closing of the valve element 120 or clogging of the pipe when large materials flow through a narrow flow path.

Soil or other foreign substances may also be caught in the enlarged portion 130. When this occurs, the area in which the sewage flows is decreased. Also, the valve element 120 can not be fully closed due to soil or other substances or may even be damaged.

These problems can, of course, be solved by increasing the diameter of the valve element 120. In such a case, it is necessary to increase the area of the diaphragm to which pressure is applied. This results in an increase in the size of the vacuum valve.

OBJECT AND SUMMARY OF THE INVENTION

It is an object of the present invention to solve the foregoing problems and provide a vacuum valve which allows smooth flow of sewage and smooth opening and closing of a valve element.

The present invention provides a vacuum valve which comprises inlet and outlet pipes connected together to form a pipe line through which sewage flows, a valve element inclined to the pipe line and providing a selective communication between the inlet and outlet pipes, and a flexible or movable partition mounted to define a pressure chamber and connected to the valve element, the valve element being moved in an inclined manner in response to pressure differential between the pressure chamber and the interior of the outlet pipe, wherein the outlet pipe has an axis displaced in a direction parallel to the axis of the inlet pipe and away from the valve element.

The problems encountered in the prior art vacuum valve result from the fact that the axis of the inlet pipe is aligned with the axis of the outlet pipe. According to the invention, the axis of the outlet pipe is displaced from that of the inlet pipe. This arrangement prevents local throttling of the pipe line which may result when the valve seat is formed, and eliminates the need for the enlarged portion.

The present invention allows smooth flow of a substantial amount of sewage and avoids those problems due to water and foreign substances contained in the enlarged portion as in the prior art vacuum valve.

Also, the present invention permits complete closing of the valve element and eliminates damage to the valve element due to foreign substances between the valve element and the valve seat.

PREFERRED EMBODIMENTS

The present invention will now be described by way of example with reference to the drawings.

Figure 1:
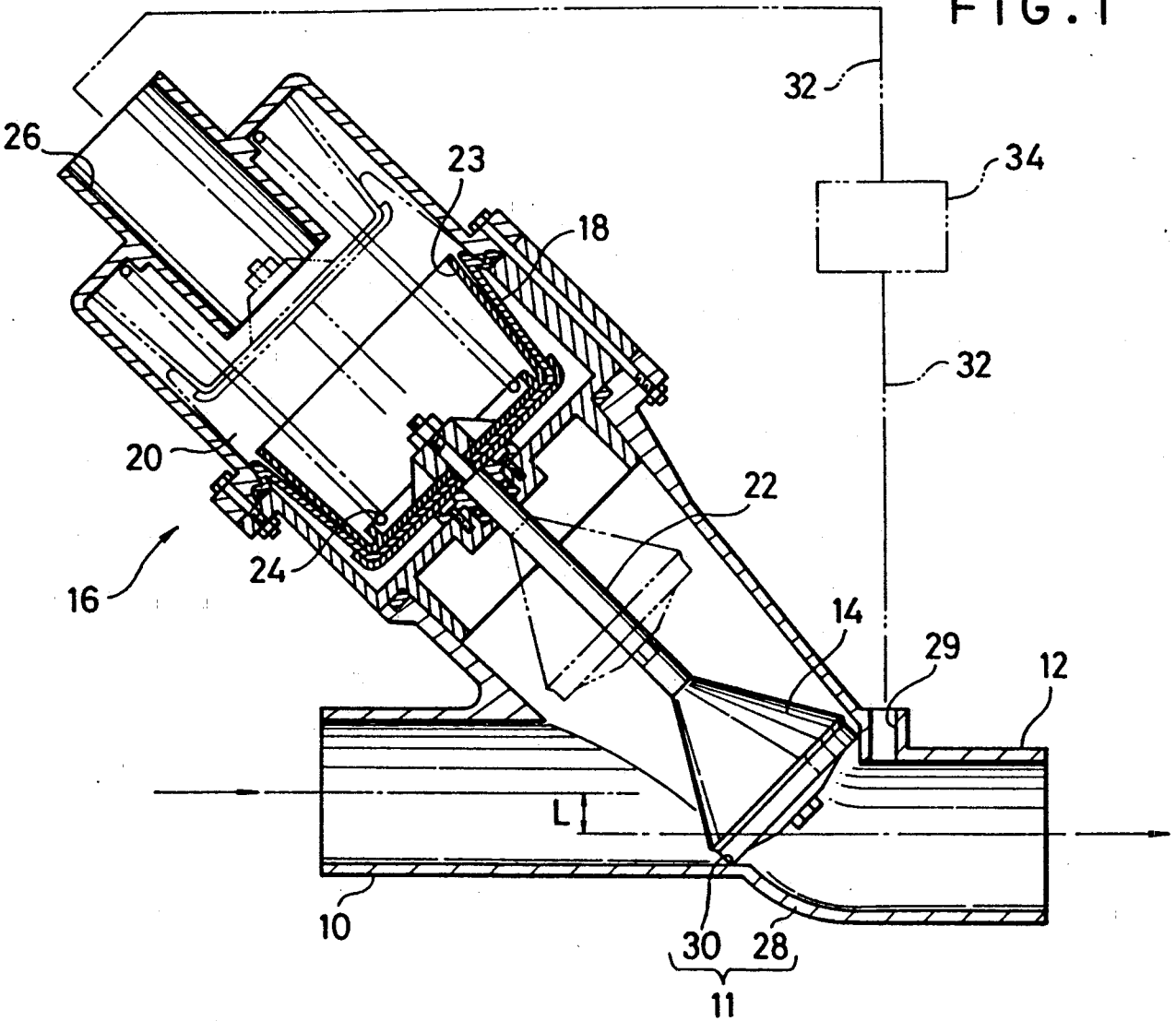
FIG. 1 is a vertical sectional view of a vacuum valve according to one embodiment of the present invention.
Figure 2:
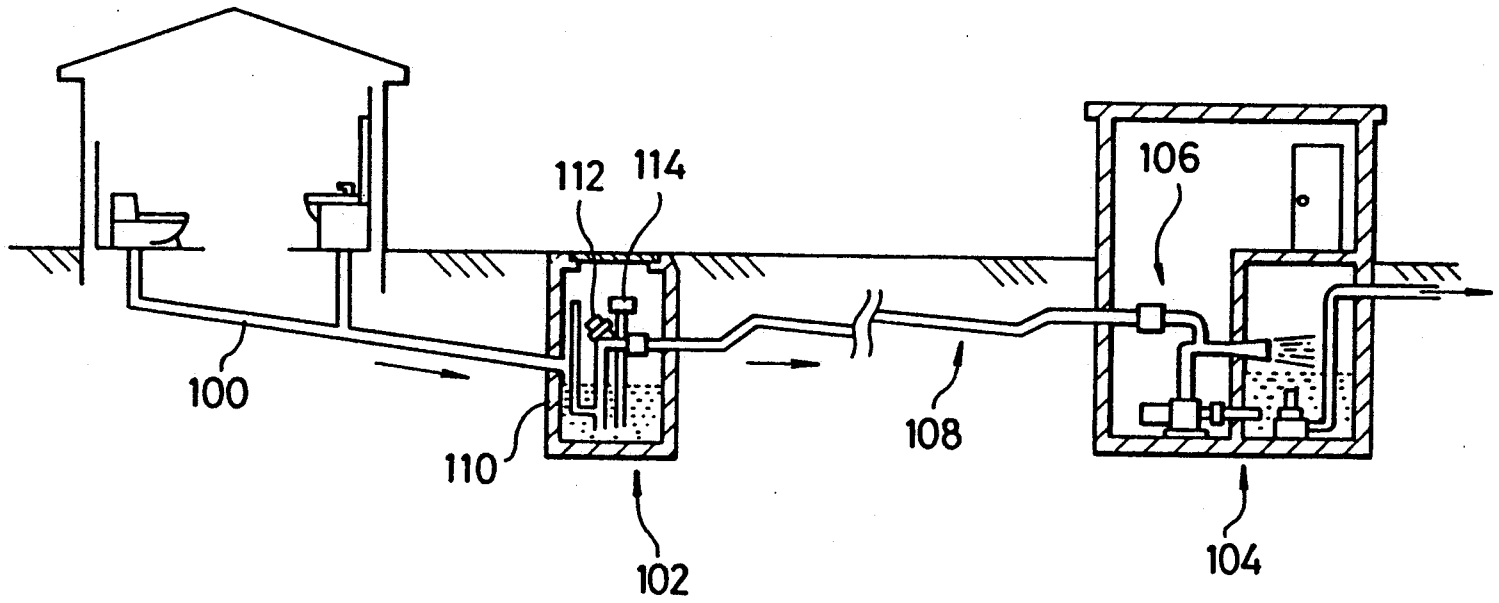
FIG. 2 illustrates a vacuum sewage collection system.
Figure 3A:
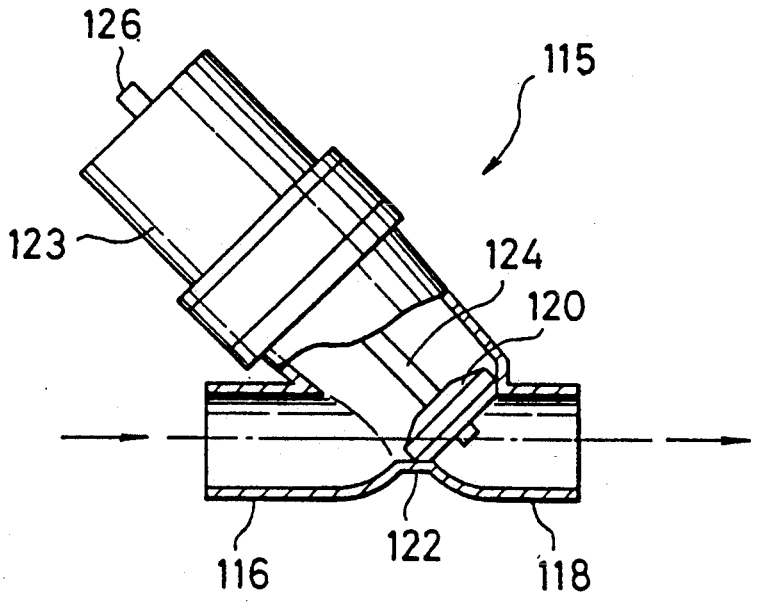
FIG. 3A Prior Art
FIGS. 3A and 3B illustrate conventional vacuum valves.
Figure 3B:
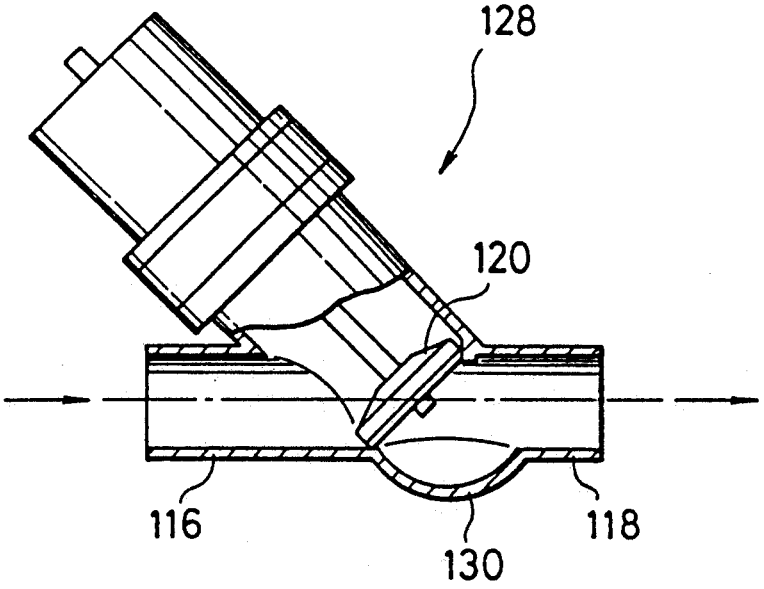
FIG. 3B Prior Art

In FIG. 1, inlet and outlet pipes are indicated at 10 and 12 and have an equal diameter. A valve element is indicated at 14 and provides a selective communication between the inlet pipe 10 and the outlet pipe 12. The inlet pipe 10 and the outlet pipe 12 are connected through a joint 11.

The inlet pipe 10 and the outlet pipe 12 together form a pipe line. The valve element 14 extends upwardly from the pipe line and is inclined at an angle of approximately 45°.

A valve drive is indicated at 16 and includes a diaphragm 18 as a flexible partition within a housing. The diaphragm 18 is mounted to define a pressure chamber 20.

The valve element 14 has a valve rod 22 which is connected to the diaphragm 18. The diaphragm 18 is displaced to reciprocate the valve element 14.

A rigid cup 23 is secured to the diaphragm 18. A spring 24 urges the cup 23 in a downward direction.

The pressure chamber 20 includes an inlet port 26. A subatmospheric pressure flows from a port 29 of the outlet pipe 12, through a pressure tube 32 and a controller 34, and into the pressure chamber 20 through the inlet port 26.

The axis of the outlet pipe 12 is located below and displaced by a distance L from that of the inlet pipe 10 (The distance L is preferably in the range of between 15 and 200 mm and most preferably between 15 and 50 mm). One end of the outlet pipe 12 is slightly curved to provide a curved portion 28 joined to the inlet pipe 10.

In the vacuum valve of this embodiment, the valve element 14 is seated on one end of the inlet pipe 10. That is, the inner surface of that end of the inlet pipe 10 serves as a valve seat 30.

When the valve element 14 is seated on the valve seat 30, no communication is established between the inlet pipe 10 and the outlet pipe 12. Thus, no suction is applied to sewage in the inlet pipe 10.

When sewage in the sewage tank is elevated to a given level, the controller is operative to direct a subatmospheric pressure to the pressure chamber 20 through the port 29 of the outlet pipe 12, the tube 32, the controller 34 and the inlet port 26.

As a result, the subatmospheric pressure in the outlet pipe 12 and that in the pressure chamber 20 are applied to the valve element 14 in opposite directions.

The area of the diaphragm 18 to which pressure is applied is greater than that of the valve element 14. Therefore, the diaphragm 18 is diaplaced upwardly in response to pressure differential when the subatmonspheric pressure is introduced to the pressure chamber 20.

The valve element 14 is then caused to move upwardly and separate from the valve seat 30 to provide a communication between the inlet pipe 10 and the outlet pipe 12. The sewage in the sewage tank is pulled under vacuum and flows toward the outlet pipe 12.

The sewage in the sewage tank is lowered as the sewage flows from the inlet pipe 10 to the outlet pipe 12. When the sewage is lowered to a given level, then the controller 34 is operative to stop introduction of the subatmospheric pressure into the pressure chamber 20 and instead, allow introduction of atmospheric pressure. The valve element 14 is then urged by the spring 24 to seat on the valve seat 30.

In the vaccum valve of this embodiment, the axis of the outlet pipe 12 is displaced so that the inner surface of one end of the inlet pipe 10 may serve as a valve seat. This arrangement also prevents the formation of a local recess in the pipe line as mentioned earlier.

The vaccum valve thus allows sewage to smoothly flow through the pipe line, prevents sewage or foreign substances from remaining in the recess, and eliminates any problems resulting therefrom.

While a preferred embodiment of the present invention has been described, it is illustrative only. In the foregoing embodiment, the vacuum valve extends in a vertical direction. Alternatively, the vacuum valve may extends in a horizontal direction. It is to be understood to one of ordinary skill in the art that various modifications may be made without departing from the spirit of the invention.

I claim:

1. A vacuum valve comprising inlet and outlet pipes connected together to form a pipe line through which sewage flows, a valve element inclined to said pipe line and providing a selective communication between said inlet and outlet pipes, and a flexible and movable partition mounted to define a pressure chamber and connected to said valve element, said valve element being moved in an inclined manner in response to a pressure differential between said pressure chamber and an interior of said outlet pipe, said outlet pipe having an axis displaced in a direction parallel to an axis of said inlet pipe and away from said valve element.

2. A vacuum valve comprising:

an inlet pipe having a straight portion at least at its front end;

an outlet pipe having a straight portion at least at its rear end;

a joint through which said inlet pipe and said outlet pipe are connected;

said straight portions of said inlet and outlet pipes being located adjacent said joint;

a valve seat provided on said joint;

a valve element selectively seated on said valve seat;

a valve rod having a front end connected to said valve element; and a valve drive connected to a rear end of said valve rod and causing said valve element to move toward and away from said valve seat;

said valve rod being inclined relative to the axis of said straight portion of said inlet pipe;

said valve seat having a seat surface extending in a direction normal to said valve rod; and said straight portion of said outlet pipe having an axis displaced from the axis of said inlet pipe in a direction opposite to said valve element.

3. 3. A vacuum valve according to claim 2, wherein the axis of said outlet pipe is displaced by a distance of at least 15 mm from the axis of said inlet pipe.

4. A vacuum valve according to claim 3, wherein the distance is in a range of between 15 and 200 mm.

5. A vacuum valve according to claim 1, wherein said joint has an inner surface slightly curved from said valve seat to said outlet pipe and extending in a direction away from said valve element.

6. A vacuum valve according to claim 1, wherein said outlet pipe has a port connected to said valve drive through means for delivering a subatmospheric pressure, said valve drive being adapted to pull said valve element to separate it from said valve seat when the subatmospheric pressure is delivered to said valve drive.

* * * * *